United States Patent [19]

Van Straaten

[11] Patent Number: 4,911,438

[45] Date of Patent: Mar. 27, 1990

[54] EXERCISING MACHINE

[75] Inventor: Willem J. Van Straaten, Sandton, South Africa

[73] Assignee: Verimark (Proprietary) Limited, Sandton, South Africa

[21] Appl. No.: 309,013

[22] Filed: Feb. 9, 1989

Related U.S. Application Data

[63] Continuation of Ser. No. 086,647, Aug. 18, 1987, abandoned.

[30] Foreign Application Priority Data

Aug. 29, 1986 [ZA] South Africa ..... 86/6575
Mar. 10, 1987 [ZA] South Africa ..... 87/1722

[51] Int. Cl.[4] ..... A63B 21/12

[52] U.S. Cl. ..... 272/138; 272/72; 272/120; 272/127; 272/134

[58] Field of Search ..... 272/72, 93, 120, 121, 272/126, 127, 134–136, 138, 144, 145

[56] References Cited

U.S. PATENT DOCUMENTS

| | | | |
|---|---|---|---|
| 1,738,987 | 12/1929 | Dattilo | 272/134 |
| 1,979,783 | 11/1934 | Williams et al. | 272/72 |
| 3,892,404 | 7/1975 | Martucci | 272/120 |
| 4,004,801 | 1/1977 | Campanaro et al. | 272/120 |
| 4,101,124 | 7/1978 | Mahnke | 272/134 |
| 4,272,074 | 6/1981 | Sferle | 272/120 |
| 4,383,684 | 5/1983 | Schliep | 272/120 |
| 4,431,184 | 2/1984 | Lew et al. | 272/120 |

FOREIGN PATENT DOCUMENTS

| | | | |
|---|---|---|---|
| 850610 | 9/1939 | France | 272/120 |
| 2236526 | 2/1975 | France | 272/138 |
| 1060282 | 3/1967 | United Kingdom . | |
| 2133706 | 8/1984 | United Kingdom . | |

*Primary Examiner*—Richard J. Apley
*Assistant Examiner*—J. Welsh
*Attorney, Agent, or Firm*—Burns, Doane, Swecker & Mathis

[57] ABSTRACT

An exercising machine having a board slidable on a beam has a rope and pulley system by means of which an exerciser sitting on the board pulls himself up an incline. To increase the resistance rubber bands are looped between axles and on the board and the beam respectively. In other embodiments other pulley systems are used and a plurality of bands may be used on each side of the machine.

8 Claims, 4 Drawing Sheets

Fig. 8
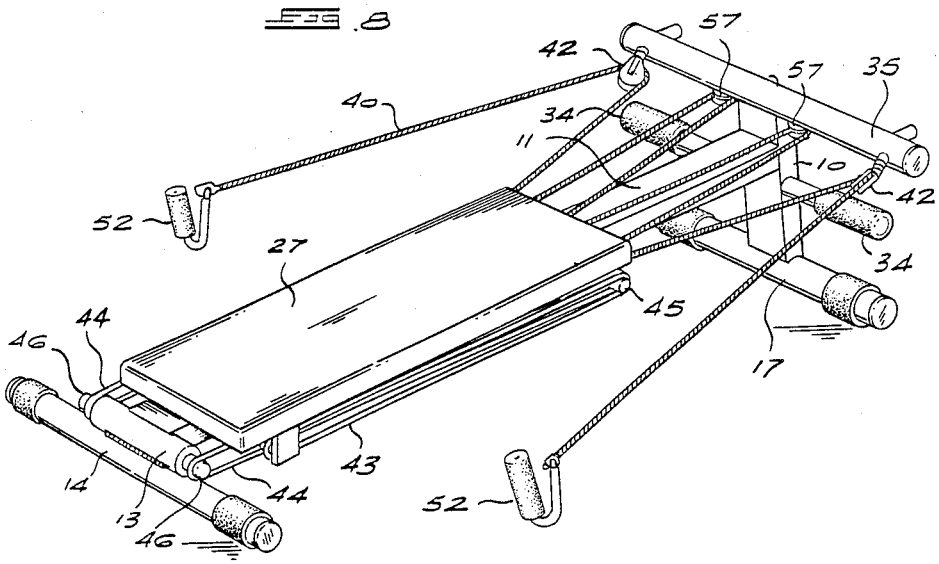
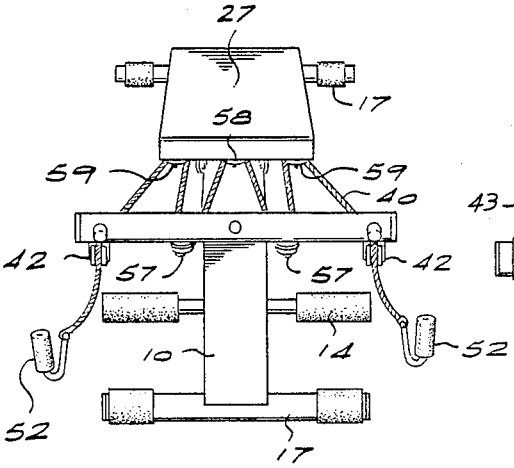
Fig. 9
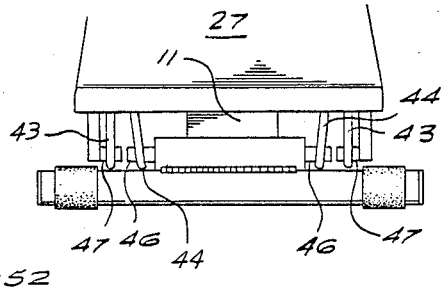
Fig. 10

EXERCISING MACHINE

This application is a continuation of application Ser. No. 07/086,647, filed Aug. 18, 1987, now abandoned.

BACKGROUND TO THE INVENTION

This invention relates to an exercising machine.

Exercising machines are known in which a person exercises against his own mass on a inclined railed system. A sliding board moves on rollers along the rail system and a person positioned on the board can cause it to move up and down by manipulating handles at the ends of ropes attached to a system of pulleys. The rail is hooked to a support structure at various elevations to increase or decrease the difficulty of exercising.

Known inclined exercising machines are relatively heavy and occupy a lot of space during exercising and in storage.

SUMMARY OF THE INVENTION

The present invention provides exercising machine comprising a frame including a rail system spanning a pair of stands, a sliding board movable along the rail system between a forward and a rearward position, a rope carrying a pair of handles attached to a system of pulleys on the board and the frame so that pulling on the rope causes the board to move towards its forward position, and at least one elastic element extending between attachment points and the rope and pulley system causing the velocity ratio between the handles and the board to be at least 3:1.

Also the system of pulleys may include a pair of first and second pulleys fixed to a bar transverse to the forward stand, a third pulley on the forward stand and a pair of fourth and fifth pulleys spaced apart at the forward end of the board, the rope being looped around the first pulley, then around the fourth pulley, around the third pulley, around the fifth pulley and finally around the second pulley.

Alternatively, or in addition the system of pulleys may include four pulleys mounted on a bar transverse to the forward stand, being first to fourth pulleys and fifth, sixth and seventh pulleys mounted on the forward end of the board, the rope being looped from the first, to the fifth, to the second, to the sixth, to the third, to the seventh and finally around the fourth pulleys.

Preferably there are a pair of elastic members, conveniently in the form of endless bands extending between the forward end of the board and the rearward stand.

In one form of the invention there is a sub axle at each side of the rearward stand for looping of an endless band, the board is fitted with a stub axle which registers with that on the stand when the board is in its rearward position, and there are a plurality of endless bands on each side which can act between the forward axle on the board and the axle on the rearward stand or be parked between the axles on the board.

The forward stand, the rail system and a connection between the rearward stand and the bottom of the forward stand preferably form a triangle, the forward end of the rail system being adjustable along the forward stand and there being transverse supports preventing the machine from falling sideways.

The rail system may comprise a beam and the forward stand may be a post with a connection being a pair of parallel struts extending between and pivoted to the transverse supports.

The forward stand preferably tilts between a position normal to which the surface on which the machine rests and towards the rearward end of the beam at angles less than 90°.

DESCRIPTION OF THE DRAWINGS

FIG. 8 is a perspective view from the side of another exercising machine

FIG. 9 is a front perspective view of the machine; and

FIG. 10 is a rear view of the machine.

DESCRIPTION OF EMBODIMENTS

Figures 1, 2, 3:
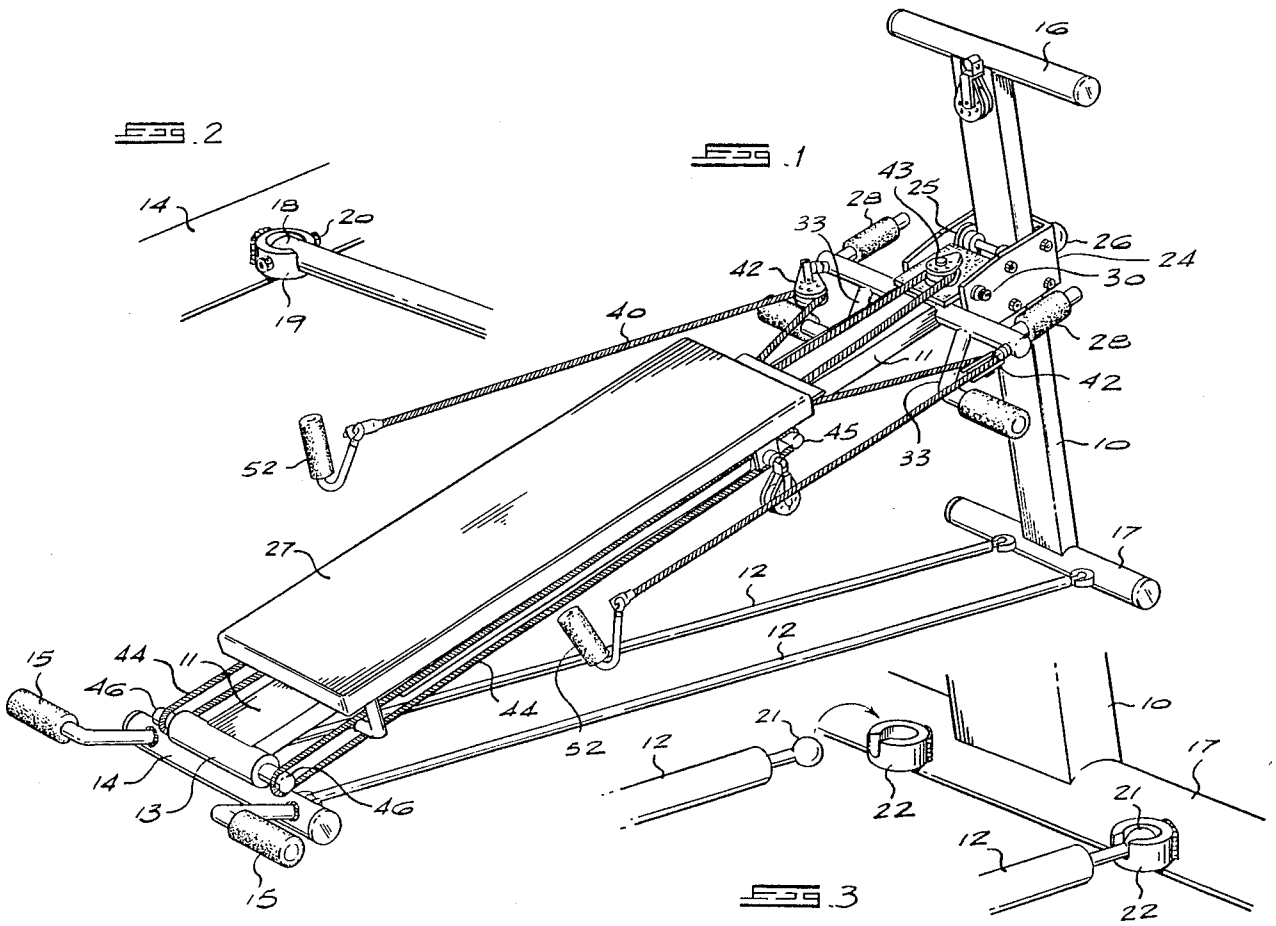
FIG. 1 is a perspective view of an exercising machine according to the invention.
FIG. 2 is an enlarged fragmentary view of a part of the machine shown in FIG. 1.
FIG. 3 is also an enlarged fragmentary view of a different part.

The principal structural elements of the machine illustrated in FIGS. 1 to 7 are a stand or leg 10, a rail or beam 11 and a pair of struts 12. The lower end of the beam 11 is secured to a boss 13 which is in turn secured to a stand or bar 14 which in use rests on the floor. Handles 15 attached to the bar 15 are used as foot or hand rests for some exercises and may also be used for moving the apparatus.

The leg 10 is fitted with a top bar 16 sometimes serving as a handle and a bottom bar 17 which mounted in use rests on the floor. The struts 12 extend between the bars 14 and 17. At the bar 14 (see FIG. 2) the strut 12 is formed with a head 18 pivotally in the bracket 19. At the bar 17 (see FIG. 3) each strut 12 is formed with a ball head 21 detachably engaging with a bracket 22 formed with a semispheroidal seat for the head 21. Thus at the bar 17 the struts can also pivot.

The upper end of the beam 11 is pinned by a pin 30 to a bracket 24 fitted with rollers 25 engaged with the leg 10. The leg 10 is formed on its rear face with a series of holes which can be engaged by a spring-biased plunger operated by a knob 26 (see FIG. 7).

Figure 7:
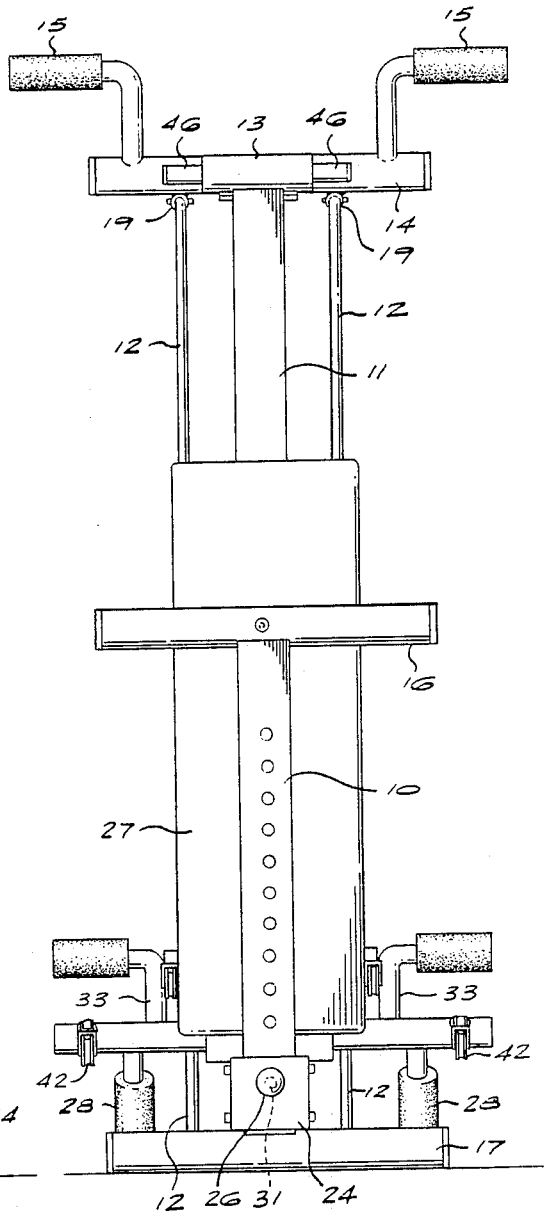
FIG. 7 is a rear view.

A board 27 runs on the beam 11 by means of rollers not shown. The length of the board is greater than one-half the length of the beam, as depicted in FIGS. 1 and 7. An exerciser manipulates a rope and pulley system while he is positioned on the board 27 to move the board up and down. The system is described later on.

For a given exercise and often for a given exerciser, the beam 11 has to be positioned at a given angle to the floor on which the bars 14 and 16 rest. To change the angle of the beam 11, the knob 26 is pulled and the bracket 24 is moved along the length of the leg 10 until the beam 11 has the desired inclination. The knob 26 is released for the plunger to enter an appropriate hole in the leg 10. In the process of changing the inclination of the beam 11, the inclination of the leg 10 relatively to the floor also changes. Effectively the lower end of the beam pivots about the pins 19 while the lower end of the leg 10 pivots about the centres of the ball heads 21. The geometry is such that in use, the leg 10 always forms an angle of less than 90° with the floor. However low down on the leg 10 there is a hole 31 for the plunger in which position the leg 10 is at 90° to the floor. In this position the struts 12 may be realeased from the brackets 22 so that the leg 10 may be folded down on the board 27. The assembly may now be lifted by the handles 15 to the position shown in FIGS. 6 and 7 to stand on the bar 17 and feet 28 projecting from foot rests 33 are attached to the beam 11.

A pair of rubber endless bands 44 are strung between axles 45 and 46 on the board and the boss 13 to bias the board 27 to the lower end of the beam.

Figure 4:
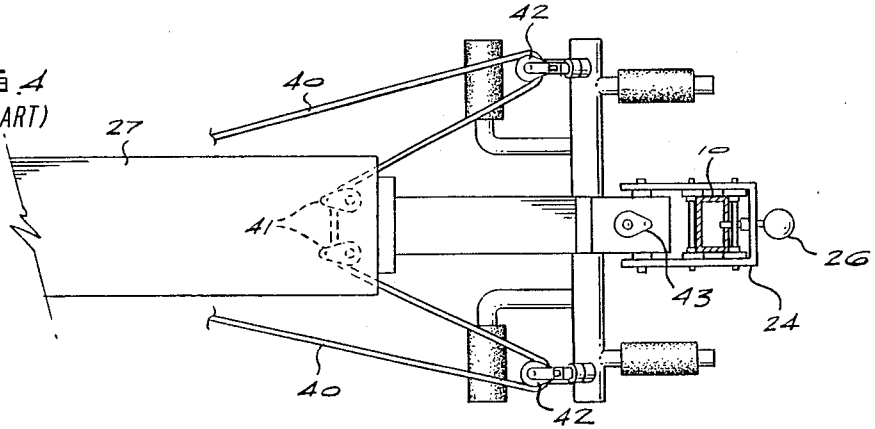
FIG. 4 (PRIOR ART)
FIG. 4 is a top view showing a conventional rope and pulley arrangement.
Figure 6:
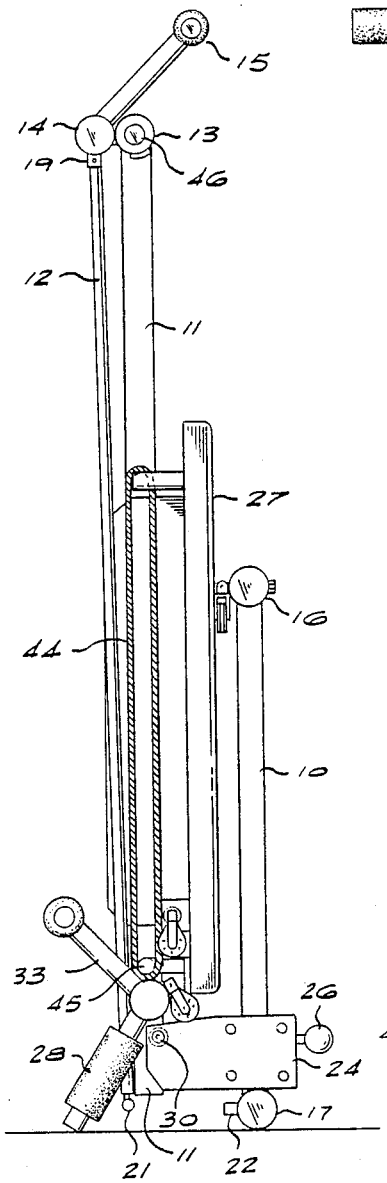
FIG. 6 is a side view of the machine in a folded position.

FIG. 4 shows a configuration of a rope 40 as used in the prior art. In this case the rope 40 passes around pulleys 41 on the board 27 and around pulleys 42 on the foot rests 33. This gives a velocity ratio of 1:1 so that to achieve a given arm movement or rope pull the board has to move a considerable distance on the beam 11.

Figure 5:
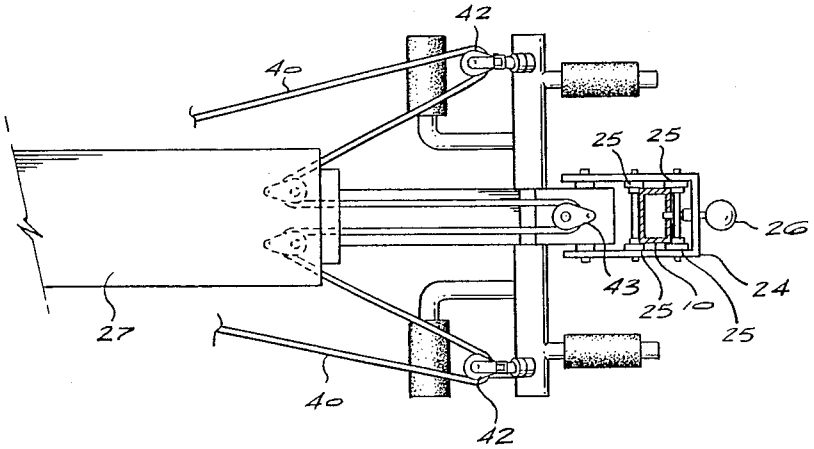
FIG. 5 is a top view showing a rope and pulley arrangement provided by the invention.

FIGS. 1 and 5 show an arrangement where the velocity ratio is increased to 2:1 with a reduction in the stroke of the board 27. In this case the rope 40 also passes around a pulley 43.

The exercising machine of FIGS. 1 to 7 does not require the massive support structure of the prior art. Also with the rubber band and pulley system of FIGS. 1 and 5 the length of the beam 11 is reduced. Adjusting the top of the beam is easy as the operator does not have to carry a large mass or push and pull on the foot of the beam. Damage to the floor is minimized.

The principal structural elements of another embodiment illustrated in FIGS. 8 to 10 are a forward leg 10, a beam 11 and a rearward leg. The leg 10 extends upwardly from a base bar 17 resting on the floor in normal use.

Projecting from the leg 10 are a pair of foot rests 34 and a top arm 35. The beam 11 serving as a rail is fixed to the leg 10 at an angle as can be seen from FIG. 8.

At its rearward end the beam 11 is fixed to the boss 13 resting on a base bar 14. The bar 14 may serve as a handle for manipulating the machine and the boss 13 and the bar 14 form a rearward stand.

A board 27 runs on the beam 11 by means of rollers. As shown, the forward end of the beam is lifted off the ground to a greater extent than the rearward end so that there is a gravity bias on the board 27 to cause it to assume a rearward position. However, the main bias is caused by two pairs of endless rubber bands 44 and 43 looped around stub axles 45 at the forward end of the board 27 and stub axles 46 projecting from the boss 13. To move the board forward the bands 44 and 43 are required to be stretched. There is also a pair of rearward stub axles 47 on the board 27. With the board 27 in its rearward position, the stub axles 46 and 47 are aligned. In a given case the bands 43 and 44 may be parked or stored on the stub axles 47. As shown the bands 43 are parked so that only the bands 44 resist the movement of the board 27.

As shown there are two pairs of bands 44 and 43, but in principle the number of bands could be increased to increase the resistance of the machine.

Forward movement of the board is achieved by pulling on handles 52 attached to the ends of a rope 40. The latter may be threaded around pulleys on the arm 35 and the board 27. On the arm 35 there are pairs of outer pulleys 42 and inner pulleys 57. On the board 27 there are a central pulley 58 and flanking pulleys 59. For a velocity ratio of 3:1 the rope 40 is threaded as shown in FIGS. 8 to 10. In other words the rope 40 comes off the pulleys 42 and passes from a pulley 42 around a pulley 59, around a pulley 57 and in the reverse direction around the pulley 58 to the pulleys on the other side. The sequence is thus 42, 59, 57, 58, 57, 59, and 42. For a 2:1 velocity ratio the sequence would be 42, 59, 57, 57, 59 and 42 with the pulley 58 missed out.

The exercising machine of FIGS. 8 to 10 is easily stored by upending it to stand on the bar 17 and the arm 35. In that position it occupies very little space.

I claim:

1. An exercising machine comprising a frame including a pair of forwardly and rearwardly spaced stands and rail means extending between said strands, a rearward one of said stands including first stub means, a sliding board of shorter length than said rail means and movable lengthwise therealong between forward and rearward positions, said sliding board being elongated in the front-to-rear direction and having front and rear ends with a second stub means mounted closely adjacent said front end, at least one elastic band wrapped around said first and second stub means for biasing said sliding board toward its rearward position, means for securing said front end of said rail means at vertically spaced locations on a forward one of said stands for adjusting the inclination of said rail means, a rope, a pair of handles attached to opposite ends of said rope, a system of pulleys mounted on said board and a front region of said rail means around which said rope extends such that a user positioned on said sliding board causes said sliding board to move forwardly against the bias of said at least one elastic band by pulling on said handles, said pulley system arranged to create a velocity ratio between said handles and sliding board to be 2:1 or greater.

2. The exercising machine according to claim 1, wherein there are two said elastic bands.

3. The exercising machine according to claim 1, wherein a forwardmost one of said stands carries a transverse bar, said pulley system comprising first and second pulleys mounted on said bar, a third pulley mounted on said forwardmost bar between said first and second pulleys, and fourth and fifth pulleys mounted at a forward end of said board, said rope looped around said first pulley, then around said fourth pulley, then around said third pulley, then around said fifth pulley, and then around said second pulley, with sections of said rope extending from said first and second pulleys carrying said handles.

4. The exercising machine according to claim 1, wherein said first stub means includes two first stub axles projecting laterally from opposite sides of said rearward stand, said second stub means including two laterally projecting second stub axles, there being two laterally projecting third stub axles disposed at a rearward end of said board, said elastic means comprising two of said first elastic bands each extending around one of said first stub axles and one of said second stub axles to bias said board rearwardly, said third stub axles positioned to be aligned with said first stub axles when said board is in its rearward position, and two second elastic bands movable between a first storage position wherein each second band extends around one of said second stub axles and one of said third stub axles to exert no bias on said board, and a second position wherein each second band extends around one of said first stub axles and one of said second stub axles to augment the biasing action of said first elastic members.

5. The exercising machine according to claim 1, wherein said forward stand, said rail means, and connecting means extending between lower ends of said front and rear stands form a triangle as said machine is viewed in side elevation, a forward end of said rail means being adjustable along said forward stand, each of said stands including laterally extending supports for preventing said machine from falling sideways.

6. The exercising machine according to claim 5, wherein said rail means comprises a beam, said forward stand comprising a post, and said connecting means comprising a pair of struts connected to said laterally extending supports.

7. The exercising machine according to claim 5, wherein said forward stand is pivotable about a horizontal axis between a position normal to a surface on which said stands rest, and positions forming acute angles to said surface.

8. The exercising machine according to claim 10, wherein said sliding board has a length longer than one-half of a length of said rail means.

* * * * *